US008056908B2

(12) United States Patent
Scott

(10) Patent No.: US 8,056,908 B2
(45) Date of Patent: Nov. 15, 2011

(54) MECHANIC'S CREEPER

(76) Inventor: David G. Scott, Tucson, AZ (US)

( * ) Notice: Subject to any disclaimer, the term of this patent is extended or adjusted under 35 U.S.C. 154(b) by 331 days.

(21) Appl. No.: 12/318,781

(22) Filed: Jan. 8, 2009

(65) Prior Publication Data

US 2009/0184482 A1 Jul. 23, 2009

Related U.S. Application Data

(60) Provisional application No. 61/006,552, filed on Jan. 18, 2008.

(51) Int. Cl.
*B25H 5/00* (2006.01)

(52) U.S. Cl. ..... 280/32.6

(58) Field of Classification Search ..... 280/32.6, 280/32.5, 79.11, 35, 639, 640; 362/486, 362/234, 253, 225; 16/37, 43, 38, 35 R
See application file for complete search history.

(56) References Cited

U.S. PATENT DOCUMENTS 4,114,232 A * 9/1978 Umeda ..... 16/35 R
4,875,694 A 10/1989 Hamrick
5,108,118 A * 4/1992 Schaevitz ..... 280/32.6
D330,619 S 10/1992 Gilbert et al.
5,213,350 A 5/1993 Hermanson
6,131,936 A * 10/2000 Eguchi et al. ..... 280/33.994
7,213,815 B2 * 5/2007 Whiteside ..... 280/32.6
7,293,783 B2 * 11/2007 Whiteside et al. ..... 280/32.6
7,363,864 B2 * 4/2008 Broek ..... 104/106
7,478,818 B1 * 1/2009 Whiteside et al. ..... 280/32.6
7,481,438 B2 * 1/2009 Hernandez ..... 280/32.6
7,726,668 B2 * 6/2010 Sieb et al. ..... 280/32.6
2005/0269792 A1 * 12/2005 Aronson ..... 280/79.11
2006/0186619 A1 8/2006 Sieb et al.

FOREIGN PATENT DOCUMENTS

FR 2250332 5/1975

* cited by examiner

*Primary Examiner* — Jeffrey J Restifo
*Assistant Examiner* — James M Dolak
(74) *Attorney, Agent, or Firm* — Richard C. Litman

(57) ABSTRACT

The mechanic's creeper has a lower body support, an upper body support and dual wheel assemblies mounted to the frame in a triangular array. The triangular positioning of the dual wheel assemblies provides for exceptional mobility when a person is working in a reclined position underneath a motor vehicle. The mechanic's creeper may have trays for holding small tools and parts attached to the frame near the lower body support.

15 Claims, 3 Drawing Sheets

MECHANIC'S CREEPER

CROSS-REFERENCE TO RELATED APPLICATION

This application claims the benefit of U.S. Provisional Patent Application Ser. No. 61/006,552, filed Jan. 18, 2008.

BACKGROUND OF THE INVENTION

1. Field of the Invention

The present invention relates to automotive tools, and more specifically, to a mechanic's creeper with a tapered wheel for maximizing maneuverability and access to the underside of a motor vehicle.

2. Description of the Related Art

Automobile mechanics have used low profile wheeled platforms, typically known as "creepers", to permit easy access to the underside of an automobile or other machinery for repair purposes for many years. Typically, these devices are more or less rectangular, wheeled platforms upon which a user may rest his or her back and maneuver underneath a motor vehicle.

Automobiles have attained a very high level of technical sophistication. In spite of the advances in automotive engineering, many of the essential systems, such as transmissions and some steering components, can only be accessed from underneath. While big automobile repair facilities that are attached to large automobile dealerships solve this problem with sophisticated jacks and hydraulic lifting systems, many smaller repair shops do not have the resources to purchase and maintain expensive and space-consuming equipment. In these types of facilities, mechanics still need to access the underside of the motor vehicles in order to make repairs.

Automobile shops and repair facilities can be dangerous. Garage floors are subjected to stress from the weight of cars and trucks and can buckle and crack. The oils and fluids that often drip from motor vehicles can be caustic. Clearances under some vehicles can be extremely limited. Certain components, such as catalytic converters and transmissions can become extremely hot and cause serious injuries. To be successful, automobile mechanics must be able to access components underneath motor vehicles and be able to maneuver safely and efficiently. Thus, a mechanic's creeper solving the aforementioned problems is desired.

SUMMARY OF THE INVENTION

The mechanic's creeper has wheel assemblies attached securely to a frame of the mechanic's creeper. The wheel assemblies use a thrust needle bearing to allow the wheels to pivot freely 360° in any direction. The wheels may be of a type commonly known as rollerblade wheels. Typically, wheels used in rollerblades are made from polypropylene, have an integral hub and a tapered silhouette to further enhance maneuverability. Upper and lower body supports are mounted to the frame.

The mechanic's creeper may have trays for holding small tools and parts attached to the frame near the lower body support.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
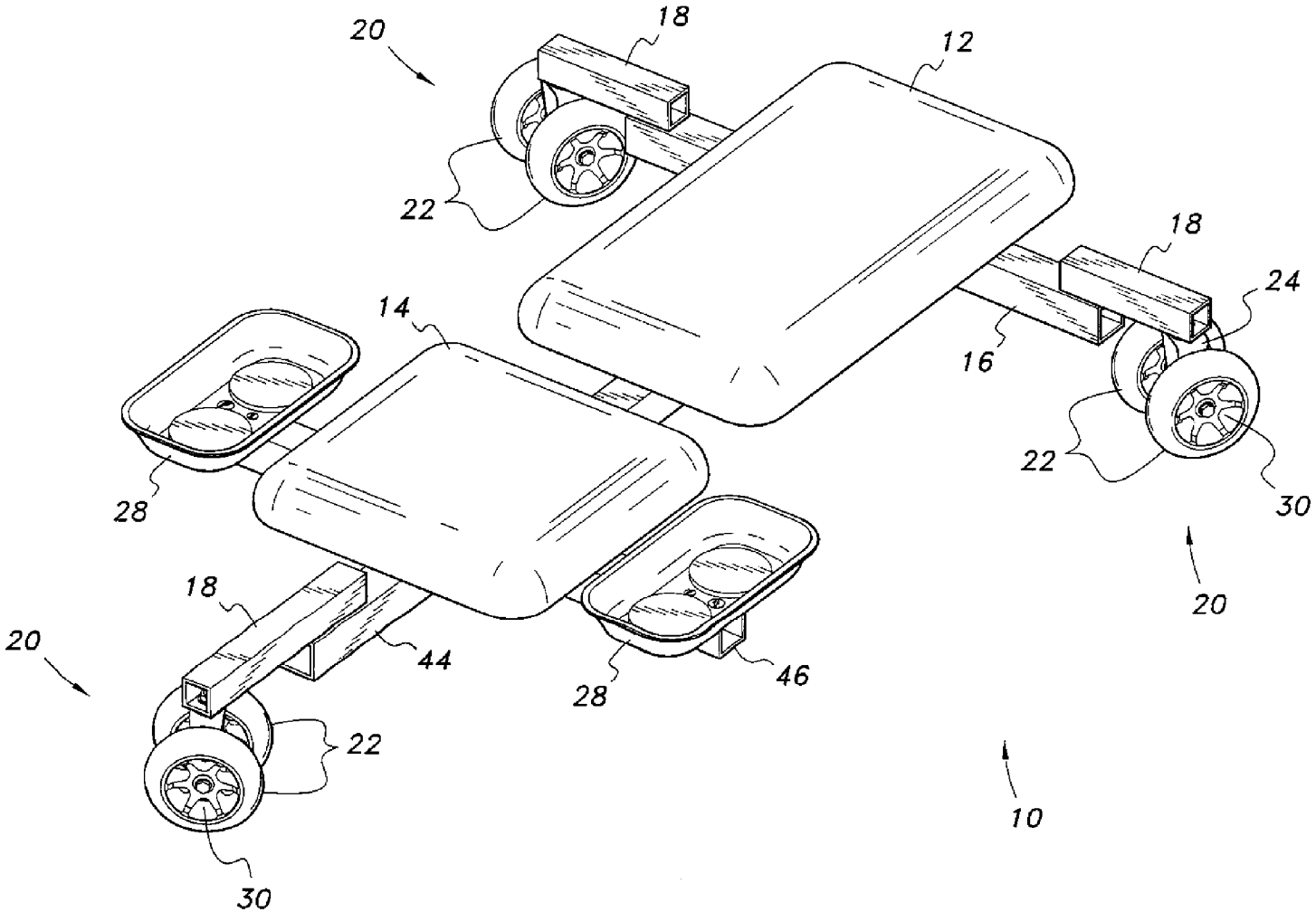
FIG. 1 is a perspective view of a mechanic's creeper according to the present invention.

The present invention relates to a mechanic's creeper with a dual wheel assembly that provides superior mobility when working in a reclined position underneath a motor vehicle. FIG. 1 is a perspective view of the mechanic's creeper, designated generally as 10 in the drawings. As illustrated in FIG. 1, the mechanic's creeper 10 includes a longitudinal rail 44 having opposed front and rear ends. A cross member 16 is attached to the longitudinal rail 44 at the rear end thereof, and a second cross member 46 is attached to the longitudinal rail 44 adjacent the front end thereof. The second cross member 46 has trays 28 secured thereto for holding small tools or parts. The pair of trays 28 are attached at opposed lateral ends of the second cross member 46.

A cushioned pad or upper body support 12 is mounted to the longitudinal rail 44 and the first cross member 16. A cushioned pad or lower body support 14 is mounted to the longitudinal rail 44 and the second cross member 46. Wheel support members 18 are attached to the longitudinal rail 44 at the front end thereof, and adjacent the upper body support 12 at each lateral end of the first cross member 16. The wheel support members 18 may be secured to rail 44 and cross member 16, respectively, by any suitable means of attachment, such as welding the support members 18 to the rail 44 and cross member 16, for example. Each wheel assembly includes dual wheels 22, with each wheel 22 having an integral hub 30.

Figure 2:
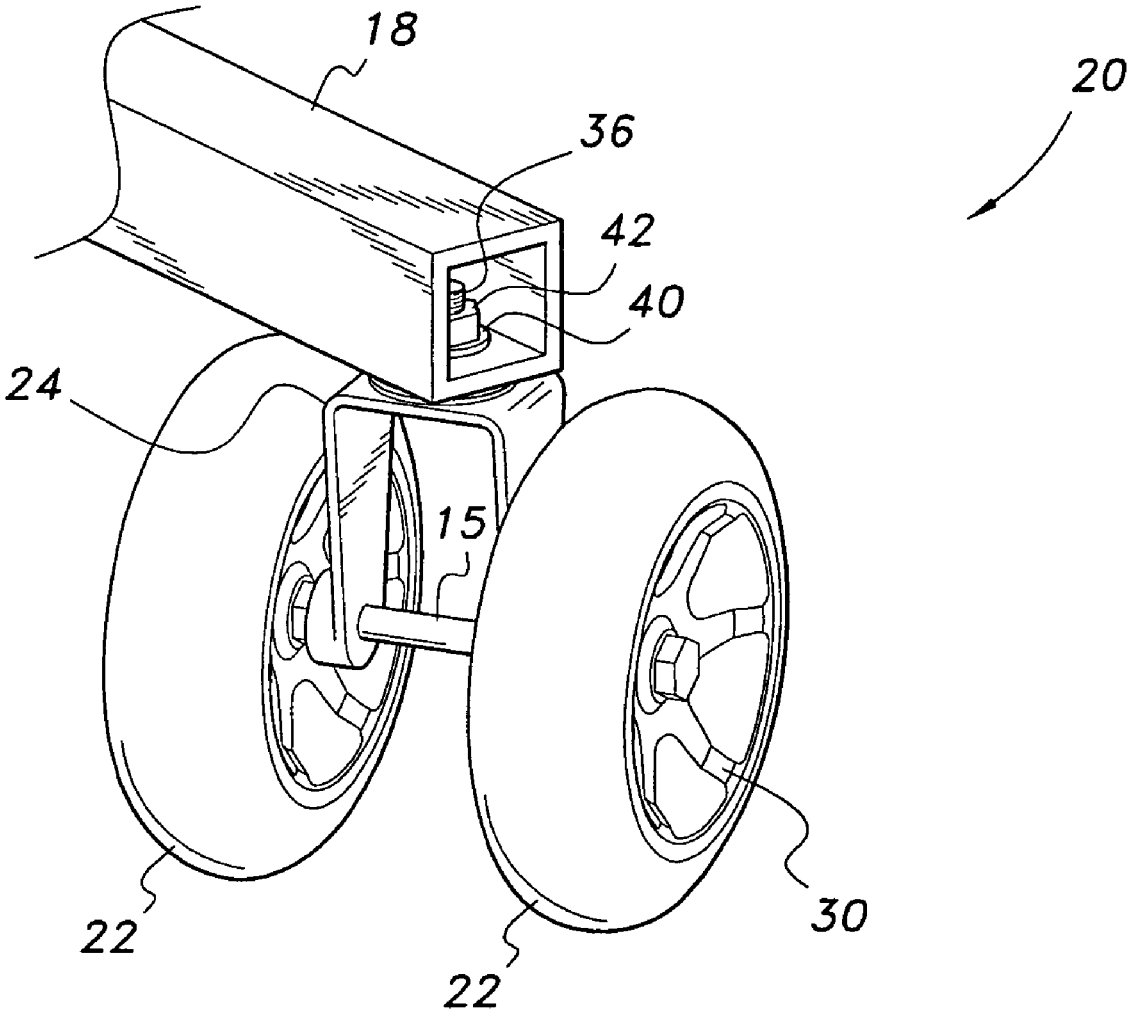
FIG. 2 is a partial perspective view of a mechanic's creeper according to the present invention, showing details of a wheel assembly.

FIG. 2 is a perspective view of the dual wheel assembly 20, and shows the wheels 22 with an integral hub 30. The wheels 22 are connected to each other (and rotatively secured to a pivoting bracket 24) by an axle 15. The axle 15 is supported by inverted U-shaped bracket 24, which is pivotally joined to the respective wheel support member 18. A bolt 36 attached to the inverted U-shaped bracket is secured to the wheel support 18 by a lock washer 40 and nut 42, as shown. The bracket 24 pivots or swivels around the bolt 36, thus allowing each pair of wheels to also pivot about the vertical axis with respect to the respective wheel support 18.

Figure 3:
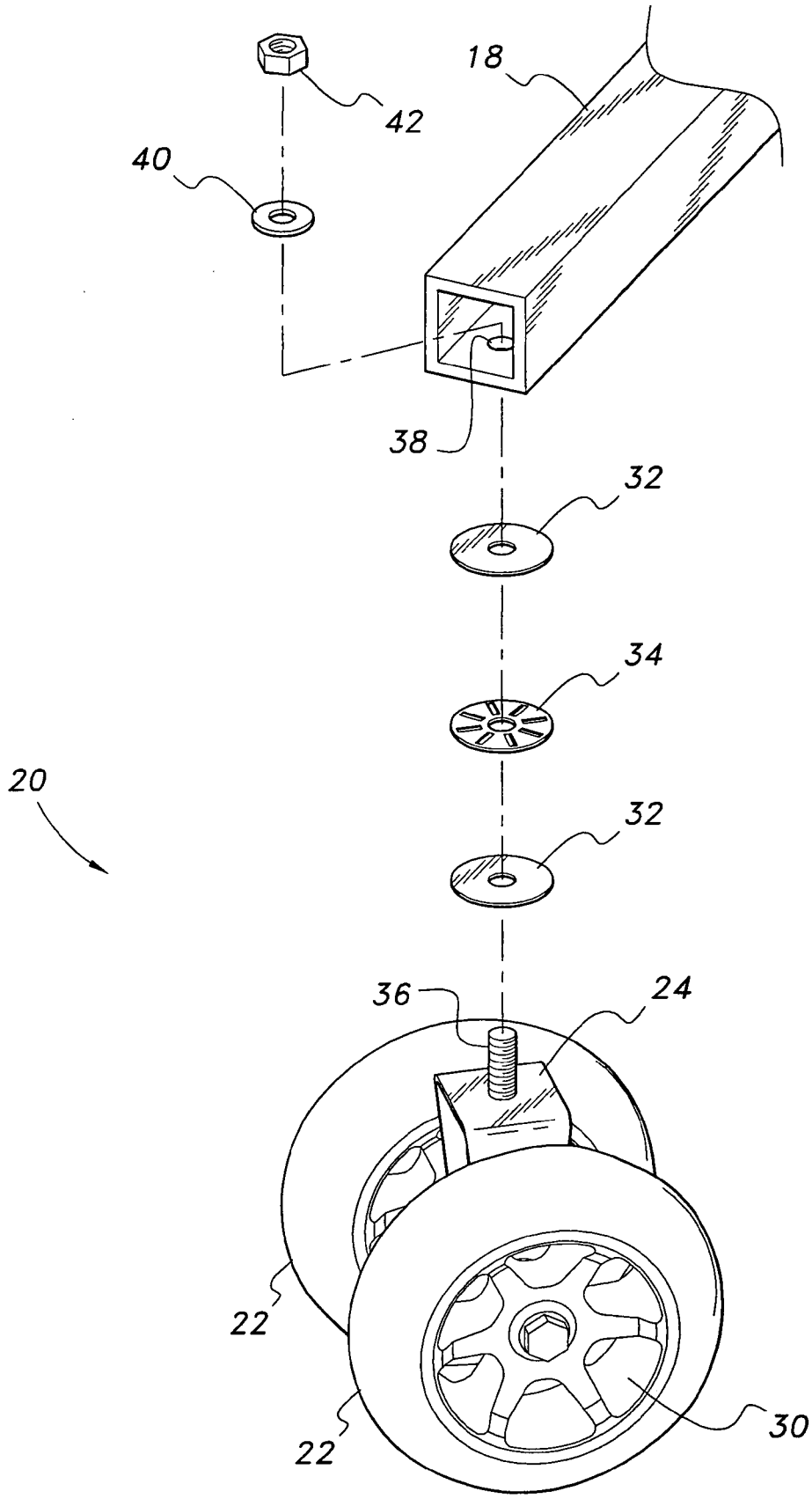
FIG. 3 is a partial perspective view of a mechanic's creeper according to the present invention, showing an exploded view of a wheel assembly.

FIG. 3 is an exploded view of the wheel assembly. A thrust needle bearing 34 is sandwiched between a pair of thrust needle washers 32 and mounted on the bolt 36. The bolt is threaded through a hole 38 in the wheel support member 18 and secured with lock washer 40 and nut 42. The thrust needle bearing 34 allows the wheels 22 to pivot a full 360° in either direction and enhances the maneuverability of the mechanic's creeper.

It is to be understood that the present invention is not limited to the embodiments described above, but encompasses any and all embodiments within the scope of the following claims.

I claim:

1. A mechanic's creeper, comprising:

a longitudinal rail having opposed front and rear ends;

a first cross member having first and second laterally opposed ends, the first cross member being attached to the longitudinal rail adjacent the front end thereof;

a second cross member having first and second laterally opposed ends, the second cross member being attached to the longitudinal rail adjacent the rear end thereof;

a first pad secured to the longitudinal rail and the first cross member, the first pad forming a lower body support;

a second pad secured to the longitudinal rail and the second cross member, the second pad forming an upper body support; and a first wheel assembly mounted to the front end of the longitudinal rail and second and third wheel assemblies respectively mounted to the first and second laterally opposed ends of the second cross member, wherein said first wheel assembly includes a first support member secured to an upper surface of the longitudinal rail adjacent the rear end thereof and extending longitudinally outwardly therefrom and at least one wheel pivotally mounted to the first support member, the at least one wheel being spaced apart from, and positioned rearwardly of, the rear end of the longitudinal rail, said second wheel assembly including second and third support members respectively secured to an upper surface of the first and second laterally opposed ends of said second cross member, with at least one wheel being pivotally mounted to each of the second and third support members and being respectively spaced apart from the first and second laterally opposed ends of said second cross member.

2. The mechanic's creeper as recited in claim 1, further comprising a pair of storage trays secured to the first and second laterally opposed ends of said first cross member.

3. The mechanic's creeper as recited in claim 2, wherein the at least one wheel of the first wheel assembly and the at least one wheel of the second and third wheel assemblies, respectively, each comprise a pair of wheels.

4. The mechanic's creeper as recited in claim 3, wherein each of said first, second and third wheel assemblies further comprises an inverted U-shaped bracket pivotally secured to a respective one of the first, second and third support members,

5. The mechanic's creeper as recited in claim 4, wherein each of said first, second and third wheel assemblies further comprises an axle joining the respective pair of wheels to the respective inverted U-shaped bracket.

6. The mechanic's creeper as recited in claim 5, wherein each of said first, second and third wheel assemblies further comprises a bolt passing through an opening formed through a respective one of the first, second and third support members and an upper surface of the respective inverted U-shaped bracket to pivotally join the inverted U-shaped bracket to the respective support member.

7. The mechanic's creeper as recited in claim 6, wherein each of said first, second and third wheel assemblies further comprises a lock washer and nut for securing the respective bolt to the respective support member and the respective inverted U-shaped bracket.

8. The mechanic's creeper as recited in claim 7, wherein each of said first, second and third wheel assemblies further comprises a thrust needle bearing disposed between a pair of thrust needle bearing washers, the thrust needle bearing and the pair of thrust needle washers being mounted on the respective bolt.

9. A mechanic's creeper, comprising:

a longitudinal rail having opposed front and rear ends;

a first cross member having first and second laterally opposed ends, the first cross member being attached to the longitudinal rail the front end thereof and a central region thereof;

a second cross member having first and second laterally opposed ends, the second cross member being attached to the longitudinal rail adjacent the rear end thereof;

a first pad secured to the longitudinal rail and the first cross member, the first pad forming a lower body support;

a second pad secured to the longitudinal rail and the second cross member, the second pad forming an upper body support;

a first wheel assembly mounted to the front end of the longitudinal rail and second and third wheel assemblies respectively mounted to the first and second laterally opposed ends of the second cross member, said first wheel assembly comprising:

a first support member secured to an upper surface of the longitudinal rail adjacent the rear end thereof and extending longitudinally outwardly therefrom; and at least one wheel pivotally mounted to the first support member, the at least one wheel being spaced apart from, and positioned rearwardly of, the rear end of the longitudinal rail; and a pair of storage trays secured to an upper surface of said first cross member, adjacent the first and second laterally opposed ends thereof, each said storage tray being spaced apart from said first pad;

wherein said second and third wheel assemblies respectively comprise:

second and third support members respectively secured to an upper surface of the first and second laterally opposed ends of said second cross member; and at least one wheel pivotally mounted to each of the second and third support members and being respectively spaced apart from the first and second laterally opposed ends of said second cross member.

10. The mechanic's creeper as recited in claim 9, wherein the at least one wheel of the first wheel assembly and the at least one wheel of the second and third wheel assemblies, respectively, each comprise a pair of wheels.

11. The mechanic's creeper as recited in claim 10, wherein each of said first, second and third wheel assemblies further comprises an inverted U-shaped bracket pivotally secured to a respective one of the first, second and third support members.

12. The mechanic's creeper as recited in claim 11, wherein each of said first, second and third wheel assemblies further comprises an axle joining the respective pair of wheels to the respective inverted U-shaped bracket.

13. The mechanic's creeper as recited in claim 12, wherein each of said first, second and third wheel assemblies further comprises a bolt passing through an opening formed through a respective one of the first, second and third support members and an upper surface of the respective inverted U-shaped bracket to pivotally join the inverted U-shaped bracket to the respective support member.

14. The mechanic's creeper as recited in claim 13, wherein each of said first, second and third wheel assemblies further comprises a lock washer and nut for securing the respective bolt to the respective support member and the respective inverted U-shaped bracket.

15. The mechanic's creeper as recited in claim 14, wherein each of said first, second and third wheel assemblies further comprises a thrust needle bearing disposed between a pair of thrust needle bearing washers, the thrust needle bearing and the pair of thrust needle washers being mounted on the respective bolt.

* * * * *